US010182600B2

(12) United States Patent
Getter et al.

(10) Patent No.: US 10,182,600 B2
(45) Date of Patent: Jan. 22, 2019

(54) BRA ASSEMBLY

(71) Applicant: Getter Right LLC, Big Bend, WI (US)

(72) Inventors: Christopher A. Getter, Big Bend, WI (US); Michelle N. Getter, Big Bend, WI (US)

(73) Assignee: Getter Right LLC, Big Bend, WI (US)

( * ) Notice: Subject to any disclaimer, the term of this patent is extended or adjusted under 35 U.S.C. 154(b) by 545 days.

(21) Appl. No.: 14/297,998

(22) Filed: Jun. 6, 2014

(65) Prior Publication Data

US 2015/0351464 A1 Dec. 10, 2015

(51) Int. Cl.

| | |
|---|---|
| ***A41C 3/04*** | (2006.01) |
| ***A41C 3/14*** | (2006.01) |
| *A41C 3/00* | (2006.01) |

(52) U.S. Cl.

CPC ..... *A41C 3/04* (2013.01); *A41C 3/144* (2013.01); *A41B 2300/32* (2013.01); *A41B 2300/322* (2013.01); *A41B 2300/326* (2013.01); *A41C 3/0071* (2013.01)

(58) Field of Classification Search

CPC ..... A41C 3/04; A41C 3/144; A41C 3/0071; A41B 2300/32; A41B 2300/322; A41B 2300/326

USPC ..... 450/36

See application file for complete search history.

(56) References Cited

U.S. PATENT DOCUMENTS

| | | | | |
|---|---|---|---|---|
| 2,613,355 | A * | 10/1952 | Coleman | A41C 3/04 2/104 |
| 3,176,692 | A | 4/1965 | Marino | |
| 4,004,294 | A | 1/1977 | Pinch | |
| 4,335,728 | A | 6/1982 | Fildan | |
| 4,355,641 | A | 10/1982 | Dastoli et al. | |
| 4,390,024 | A | 6/1983 | Williams | |
| 4,423,734 | A | 1/1984 | Schawel | |
| 4,425,689 | A | 1/1984 | Fildan | |
| 4,528,699 | A | 7/1985 | Hughes | |

(Continued)

FOREIGN PATENT DOCUMENTS

| | | | |
|---|---|---|---|
| CN | 2256222 | Y | 6/1997 |
| JP | 2004218119 | A | 8/2004 |
| WO | 2012119213 | A1 | 9/2012 |

OTHER PUBLICATIONS

International Search Report and the Written Opinion of the International Searching Authority; Application No. PCT/US2014/067552—(13) pages.

*Primary Examiner* — Timothy K Trieu
(74) *Attorney, Agent, or Firm* — Boyle Fredrickson S.C.

(57) ABSTRACT

Bras and methods of forming bras suitable for nursing activities and closure assemblies that are convenient to manipulate. The bra assembly includes a pair of breast cups that are secured to a torso band. A first closure assembly is disposed between each breast cup and the torso band and extends in a lateral direction generally below a respective breast. A second closure assembly includes first and second portions that are each secured to a respective breast cup. The first and second portions of the second closure removably cooperate with one another such that each breast can be selectively exposed by lateral outward translation of the respective breast cup. Another aspect of the invention includes a closure assembly that reduces the number of clasp associations that must be manipulated to effectuate the opening/closing of the bra assembly.

14 Claims, 10 Drawing Sheets

(56) References Cited

U.S. PATENT DOCUMENTS

| | | | | |
|---|---|---|---|---|
| 4,550,734 | A | 11/1985 | Porco | |
| 4,633,876 | A | 1/1987 | Scullin | |
| 4,648,404 | A | 3/1987 | Clark | |
| 4,878,879 | A | 11/1989 | Kunstadter | |
| 4,911,677 | A | 3/1990 | White | |
| D321,273 | S | 11/1991 | Hull | |
| D351,492 | S | 10/1994 | Nieslanik | |
| 5,380,238 | A | 1/1995 | Crew-Gee | |
| 5,461,725 | A | 10/1995 | Witczak | |
| 5,611,086 | A | 3/1997 | Eggen | |
| 5,873,768 | A * | 2/1999 | Fleischman-Ament | A41C 3/0057 2/73 |
| 6,074,273 | A | 6/2000 | Turner et al. | |
| 6,123,601 | A | 9/2000 | Hildebrandt | |
| 6,264,529 | B1 | 7/2001 | Logue | |
| 6,319,092 | B1 | 11/2001 | Leyhe et al. | |
| 6,346,027 | B1 | 2/2002 | Merkovsky | |
| 6,361,398 | B1 | 3/2002 | Knapp | |
| 6,381,752 | B1 | 5/2002 | Cartelli | |
| 6,733,362 | B2 | 5/2004 | Brassiere | |
| D505,243 | S | 5/2005 | Thunstedt | |
| D523,212 | S | 6/2006 | Iourina | |
| 7,232,359 | B1 | 6/2007 | Richardson | |
| 7,314,400 | B2 | 1/2008 | Fildan et al. | |
| 7,448,090 | B2 | 11/2008 | Lucock | |
| 7,448,936 | B1 | 11/2008 | Kemp-Dorsey | |
| D625,487 | S | 10/2010 | Hendrickson | |
| 7,810,171 | B2 | 10/2010 | Moore | |
| D632,609 | S | 2/2011 | Corrado | |
| D632,610 | S | 2/2011 | Corrado | |
| 7,878,880 | B2 | 2/2011 | Hendrickson | |
| 8,075,369 | B2 | 12/2011 | Hendrickson | |
| 8,118,638 | B2 | 2/2012 | Forbes | |
| 8,147,291 | B2 | 4/2012 | Hirtz | |
| 8,192,247 | B2 | 6/2012 | Abbaszadeh | |
| 8,323,070 | B2 | 12/2012 | Abbaszadeh | |
| 8,328,597 | B2 | 12/2012 | Forbes | |
| 8,469,769 | B2 | 6/2013 | Hendrickson | |
| 8,469,770 | B2 | 6/2013 | Alva | |
| 8,540,549 | B2 | 9/2013 | Drew | |
| 8,657,643 | B2 | 2/2014 | Perez | |
| 8,668,547 | B2 | 3/2014 | Boonen et al. | |
| 2004/0058618 | A1 * | 3/2004 | Yang | A41C 3/0071 450/38 |

* cited by examiner

BRA ASSEMBLY

FIELD OF THE INVENTION

The present invention relates generally to women's apparel, and more particularly, to bra assemblies configured to accommodate selective exposure of a breast to facilitate nursing activities. Another feature of the disclosed assembly includes a closure assembly that is configured to manipulate the number of discrete closures or clasps that must be manipulated to effectuate "opening" or "closing" of the bra assembly.

BACKGROUND OF THE INVENTION

Nursing apparel is provided in a variety of shapes and configurations for accommodating selective exposure of a breast to facilitate nursing activities. Some such apparel is provided simply as a camisole. Many user's appreciate the degree of unencumbered comfort associated with such apparel but can be rendered uncomfortable due to the lack of breast support as well as the potential for inadvertent but fairly common unexpected leakage of the breast. Recognizing such shortcomings, others provide nursing garments in the form of a bra which provides enhanced support of the breast. Unfortunately, many such articles of apparel are susceptible to other drawbacks.

Many nursing bras include respective breast cups that can be swung in a generally downward direction such that the cup generally underlies a nursing child. The orientation of the breast cup generally below the nursing child frequently results in the bra cup absorbing breast milk during the feeding activity rendering the wearer with wet apparel until the same can be changed. Recognizing such a shortcoming, many such nursing bras are configured to include an interchangeable absorbent insert to mitigate the detrimental consequences of wet apparel. Unfortunately, such inserts frequently compress the breast, exacerbating undesirable leakage, and alter the fit of the nursing bra thereby detracting from the comfort associated with wearing the same.

In addition to the inserts, and the size and/or wetness associated therewith, many such bra arrangements commonly only have a limited degree of adjustment. The limited degree of adjustment, particularly for women with larger cup sizes and/or highly productive lactation can result in bra assemblies that are only comfortable for limited durations of the nursing cycle as the child grows and the volumes associated with feeding change. Such considerations can result in increased expense as users must commonly have various bras of different sizes to satisfy the demands of nursing without being considered as providing inadequate support or as being too constrictive.

Still other nursing bra assemblies include breast covering portions or cups that are movable in lateral directions but such systems suffer from various alternate drawbacks in addition to some of the drawbacks discussed above. Some such arrangements include a cup portion that movably cooperates with a triangular strap portion wherein the triangular straps generally circumferentially surround the nipple portion of the breast. Displacement of the strap portions can interfere with feeding activities and the radial positioning of the straps concentrate the forces associated with supporting the breast into limited narrow bands resulting in discomfort. Still other arrangements result in concurrent exposure of both breasts such that the non-feeding breast must commonly be covered with ancillary apparel and/or coverings. Such an arrangement also leaves the alternate breast wholly unsupported. Still further, such bra apparel commonly includes closure assemblies that require two hands to effectuate the desired exposure of a breast. This task is commonly complicated by the presence of a child intended to be nursed such that the wearer commonly only has one hand free to achieve the exposure of a desired breast.

Therefore, there is a need for a nursing bra arrangement that allows selective exposure of nearly the entirety of a single breast, does not interfere with the feeding activity, maintains support of a non-feeding breast, can be quickly and conveniently manipulated by a single hand, and is displaced relative to the feeding activity to maintain a dry and sanitary condition of the respective breast covering.

BRIEF DESCRIPTION OF THE INVENTION

The present invention discloses a bra assembly and bra closure assemblies that overcome one or more of the shortcomings discussed above. One aspect of the invention discloses bras and methods of forming bras suitable for nursing activities. The bra assembly includes a pair of breast cups that are selectively securable to a torso band. A first closure assembly is disposed between each breast cup and the torso band and extends in a lateral direction generally below a respective breast. A second closure assembly includes first and second portions that are each secured to a respective breast cup. The first and second portions of the second closure removably cooperate with one another such that each breast can be selectively exposed by lateral outward translation of the respective breast cup.

Another aspect of the invention that is usable or combinable with one or more of the above aspects or features discloses a bra assembly having a torso band that is configured to extend about a torso of a wearer. The assembly includes a first breast cup and a second breast cup that are each connected to the torso band and each have a generally triangular shape defined by a laterally outward edge, a cleavage edge, and an upper edge. A first shoulder strap and a second shoulder strap each extend between a respective one of the first breast cup and the second breast cup and a back portion of the torso band. A first closure assembly and a second closure assembly are disposed between a respective breast cup and the torso band. Each of the first and second closure assemblies are operable to selectively secure a longitudinal lower edge of the respective first and second breast cup to the torso band. A third closure assembly is isolated from the torso band and includes a first portion that is secured to the cleavage edge of the first breast cup and a second portion that removably cooperates with the first portion and is secured to the cleavage edge of the second breast cup such that the first breast cup and the second breast cup can each be selectively swung in a respective outward lateral direction to expose a breast disposed therebehind without affecting a position of the other breast cup.

Another aspect of the invention that is usable or combinable with one or more of the above aspects discloses a method of forming a nursing bra. The method includes connecting a right breast cup to a left breast cup with a torso band that is connected to respective lateral outward edges of the respective right and left breast cups. A bottom edge of each of the right and left breast cups is connected to the torso band with a respective variable length closure that includes a first portion that is secured to a respective one of the right and left breast cups and a second portion that is secured to the torso band. A cleavage edge of each of the right breast cup and the left breast cup is connected to each other with a selectively operable closure that assists operation of the variable length closure during opening and closing operation of each of the right and left breast cups.

Another aspect of the invention that is useable with one or more of the above aspects discloses an assembly that includes a first frame body and a second frame body that removably cooperate with each other and removably cooperate with respective portions of a bra closure or clasp assembly. The first frame body includes at least two eyelets that are attached thereto. Each of the at least two eyelets are oriented to removably cooperate with a hook of a bra closure. The second frame body includes at least two hooks that are attached thereto and oriented to cooperate with a respective eyelet of the bra closure. The assembly includes a first clasp portion that is defined by the first frame body and a second clasp portion that is defined by the second frame body. The first clasp portion and the second clasp portion removably cooperate with one another to open and close the bra closure with fewer interfaces than associated with cooperation of the hooks and eyelets of the bra closure.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
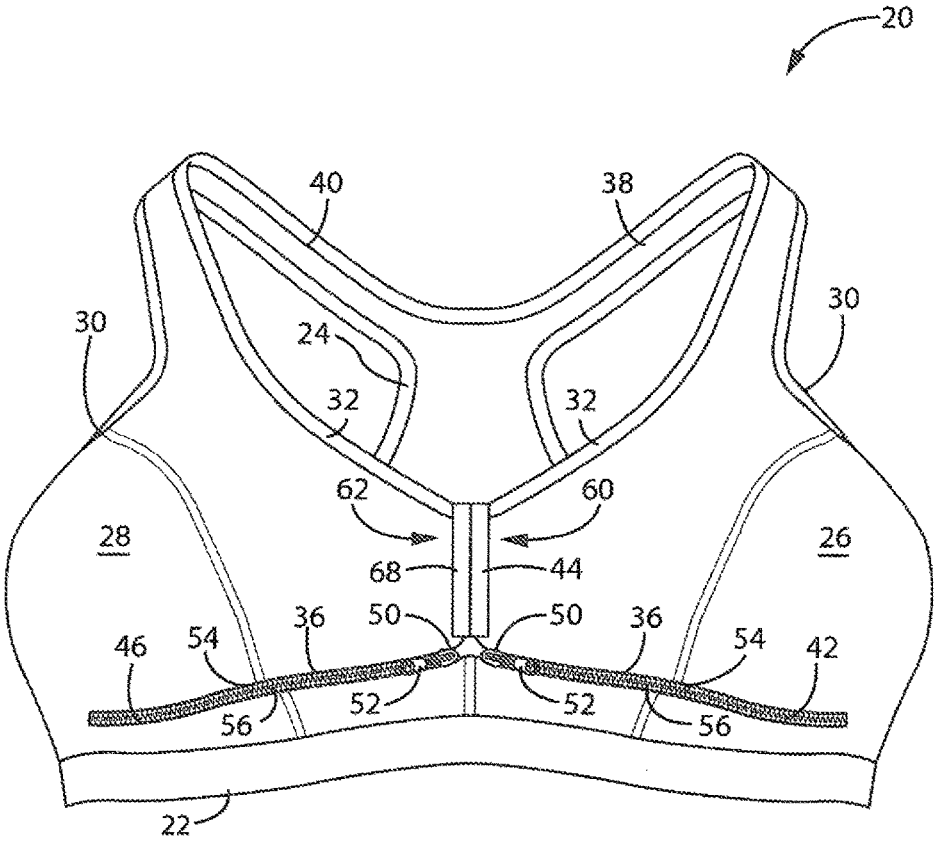
FIG. 1 is a front perspective view of a bra assembly according to one embodiment of the invention.

In describing the various embodiments of the invention, which is illustrated in the drawings, specific terminology will be referred to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DETAILED DESCRIPTION OF THE PREFERRED EMBODIMENT

The present invention and the various features and advantageous details thereof are explained more fully with reference to the non-limiting embodiments described in detail in the following description.

Figure 2:
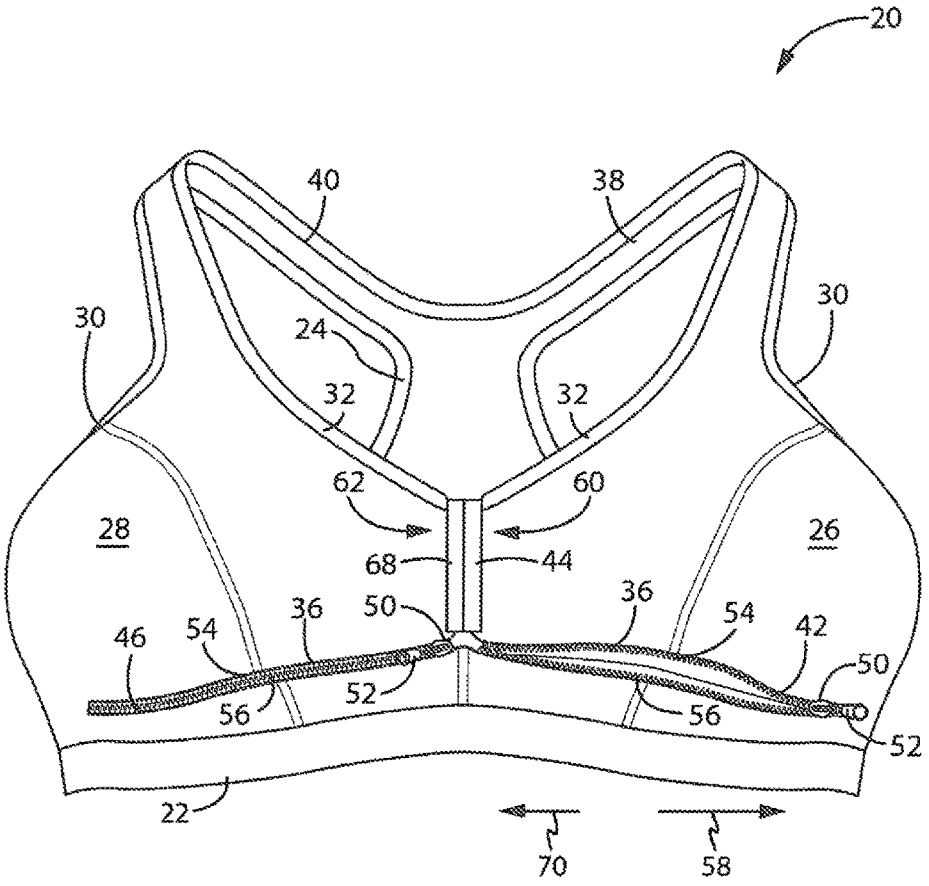
FIG. 2 is a view similar to FIG. 1 and shows a first closure mechanism: associated with one respective breast cup in an open position and a second closure mechanism associated with both breast cups in a closed position.
Figure 3:
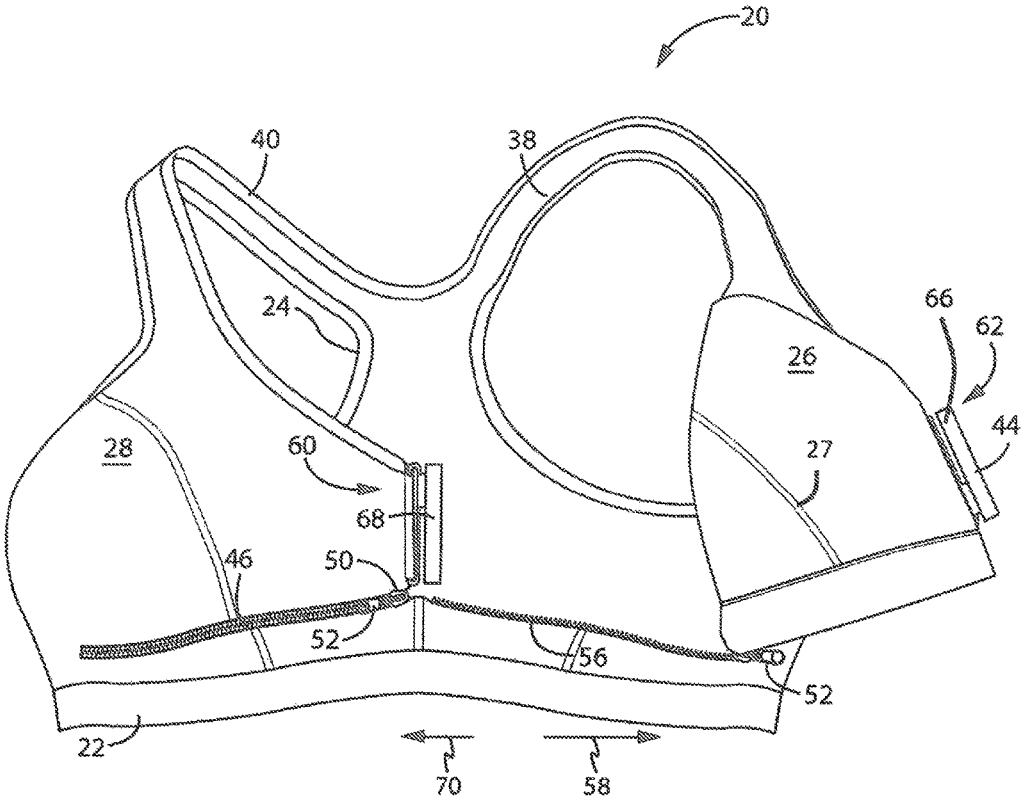
FIG. 3 is a view similar to FIGS. 1 and 2 with the first and second mechanisms in an open position such that one breast can be exposed and a third closure mechanism associated with the second breast cup in a closed position such that the second breast remains covered and supported.

FIGS. 1-3 show various views of a bra assembly 20 according to one embodiment of the invention. Bra assembly 20 is generally defined by a band or torso band 22, a back portion 24, a first breast cup 26, and a second breast cup 28. Torso band 22 preferably extends circumferentially about the torso of a wearer and generally proximate a horizontal plane associated with an underside of the breasts. Torso band 22 is generally continuous such that the torso band includes no separable ends. Such bra assemblies are commonly referred to as "sports bras" although it is appreciated that the present invention may be provided in other bra configurations such as those utilizing front and/or rear closure mechanisms associated with providing separable ends of the torso band as disclosed further below.

Still referring to FIGS. 1-3, each breast cup 26, 28 includes a lateral outer edge 30 in inner upward facing edge 32 and a lower facing edge 36. Edges 30, 32, 36 are generally shaped and sized to generally surround the breast tissue of a wearer. Respective shoulder straps 38, 40 extend from an intersection associated with edges 30, 32 and cooperate with a rear or back portion 24 of bra assembly 20. Bra assembly 20 includes a plurality of closure mechanisms 42, 44, 46 that are selectively operable to allow selective exposure of a single breast while maintaining an orientation of the alternate cup 26, 28 so as to maintain an unexposed condition associated with the alternate breast which remains disposed therebehind.

Respective discrete first breast cup closure assembly and second and breast cup closure assembly or first and third closure mechanisms 42, 46, respectively, are each provided as variable length closure mechanisms, such as a zipper, wherein a respective degree of an "open" or "closed" condition of the closure mechanism is defined by a variable degree of operation or interaction with the respective closure mechanism. It is appreciated that the variable length closure mechanisms could be provided in other operational modalities, such as plurality of snap and buttons for example, wherein operation of the respective closure mechanism allows incremental securing of the interface between each respective breast cup and the torso band. Each zipper includes a slider 50, an optional pull tab 52, a first toothed interface 54 and a second toothed interface 56. As is commonly understood, the degree of the "open" or "closed" condition associated with closure mechanisms 42, 46 is commonly associated with the position of slider 50 relative to cooperating interaction associated with toothed interfaces 54, 56.

First toothed interface 54 is attached to lower facing edge 36 of a respective breast cup 26, 28 and selectively interacts with the respective toothed interface 56 secured to torso band 22 to accommodate the selective opening and or closing of the respective first and third closure mechanisms 42, 46. Referring to FIGS. 1 and 2, inward lateral translation of slider 50 associated with closure mechanism 42, indicated by arrow 58, accommodates separation between breast cup 26 and torso band 22 along nearly the entirety of the underside of the breast. As used herein, the directional terms inward and outward lateral directions refer to directions toward and away from the cleft generally defined by the cleavage of the wearer or vertical longitudinal line between the breasts of the wearer. When "closed", the cleavage edge closure assembly or closure mechanism 44 maintains cooperation between respective cleavage edges 60, 62 associated with respective breast cups 26, 28 thereby accommodating single-handed operation of a respective closure mechanisms 42, 46 without removal of the breast cup relative to the respective breast disposed therebehind.

As shown in FIGS. 1-3, closure mechanism 44 defines an elongated clip that includes a first portion 66 that is secured to cleavage edge 60 associated with first breast cup 26 and a second portion 68 that is secured to cleavage edge 62 associated with second breast cup 28. First and second portions 66, 68 of closure mechanism 44 removably cooperate with one another, preferably via relative rotation about an axis aligned with a longitudinal axis of the elongated clip between the respective first and second portions 66, 68, to allow selective separation of cleavage edges 60, 62 associated with breast cups 26, 28.

Referring to FIGS. 2 and 3, when first closure mechanism 42 is opened such that slider 50 is positioned nearer the outer lateral edge of breast cup 26 than cleavage edge 60, separation of first portion 66 and second portions 68 of closure mechanism 44 allows breast cup 26 to be rotated in an outward lateral direction toward the arm of the user to nearly entirely expose a breast disposed therebehind. It is appreciated that size of the breasts as well as the fit of the bra assembly may result in a configuration wherein a portion of an "open" breast cup somewhat overlies the outward lateral side surface of a respective breast.

As shown in FIG. 3, the closed configuration of closure mechanism 46 relative to torso band 22 maintains breast cup 28 in an orientation wherein breast cup 28 maintains coverage of the breast disposed behind breast cup 28 while the breast associated with breast cup 26 is nearly fully exposed. Upon completion of a feeding activity, first portion and second portions 66, 68 of closure mechanism 44 are re-associated with one another such that translation of slider 50 in a closing direction, indicated by arrow 70, effectively repositions breast cup 26 over the previously exposed breast. It is further appreciated that each of breast cups 26, 28 can include a pad 27. Cooperation of a breast with breast cup 28 facilitates a single-handed interaction associated with reorienting first and second portions 66, 68 of closure mechanism 44 relative to one another during the "closing" operation such that closure mechanisms 42, 44, 46 can each he manipulated in the single-handed manner. Such a feature is particular advantageous for nursing activities wherein the wearer is already holding a child.

In view of the above, it should also be appreciated that cooperation and operation of closure mechanism 46 and closure mechanism 44 accommodate the exposure of the breast disposed behind breast cup 28 while maintaining a covered orientation of the breast disposed between breast cup 26 to facilitate nursing activities associated with the alternate breast. As alluded to above, it is understood that bra assembly 20 is shown as what is commonly understood as a sports bra in that there is no separable front or rear closure assembly associated with facilitating removal or replacement of the bra assembly relative to the wearer aside from translating the apparel generally over the head of the wearer such that the neck of the wearer extends between shoulder straps 38, 40 and the arms of the wearer extend from openings oriented laterally outward relative to a respective shoulder strap 38, 40. Understandably, not all users appreciate such apparel.

Figure 4:
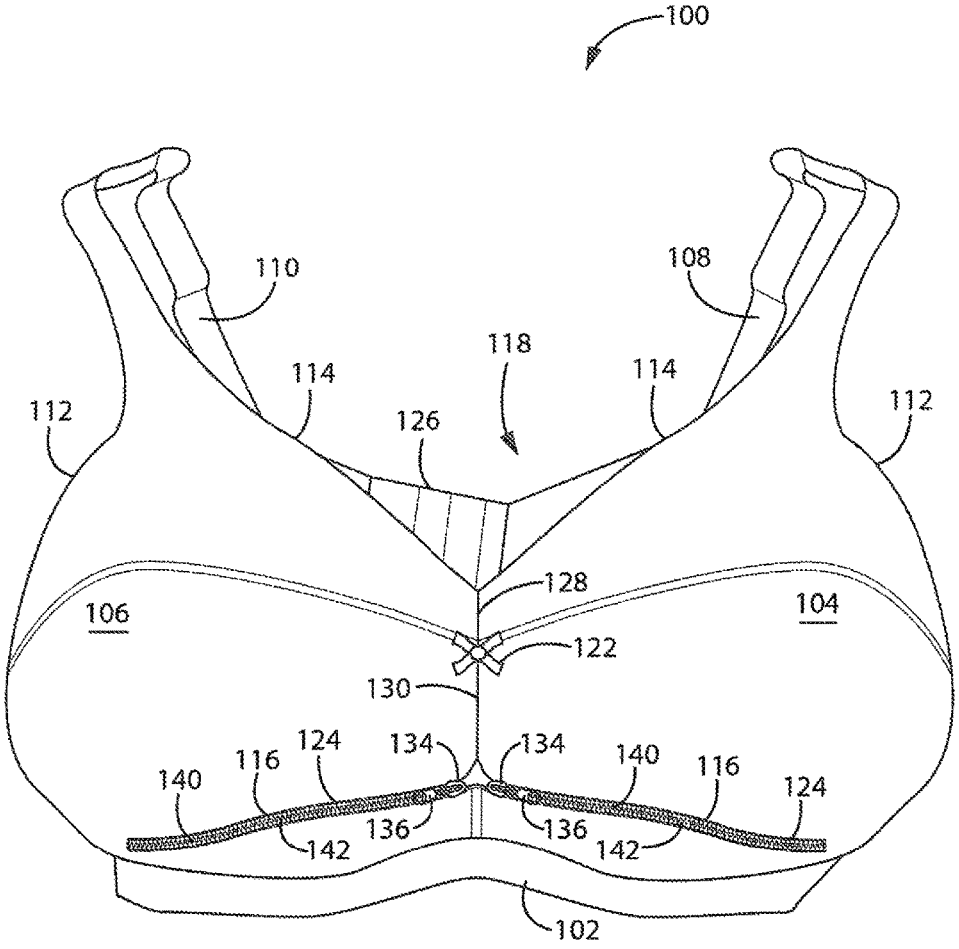
FIG. 4 is a view similar to FIG. 1 of a bra assembly according to another embodiment of the invention.
Figure 5:
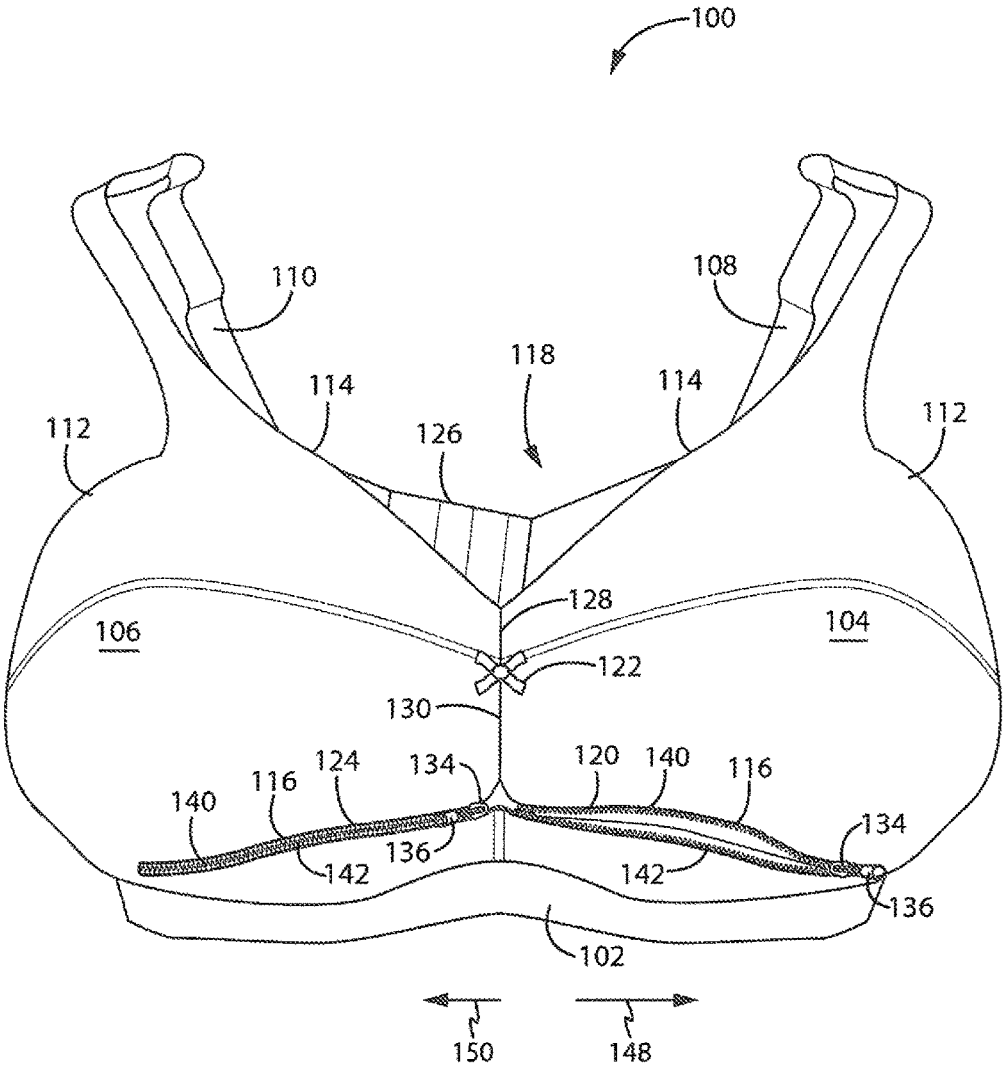
FIG. 5 is a view similar to FIG. 2 of the bra assembly shown in FIG. 4.
Figure 6:
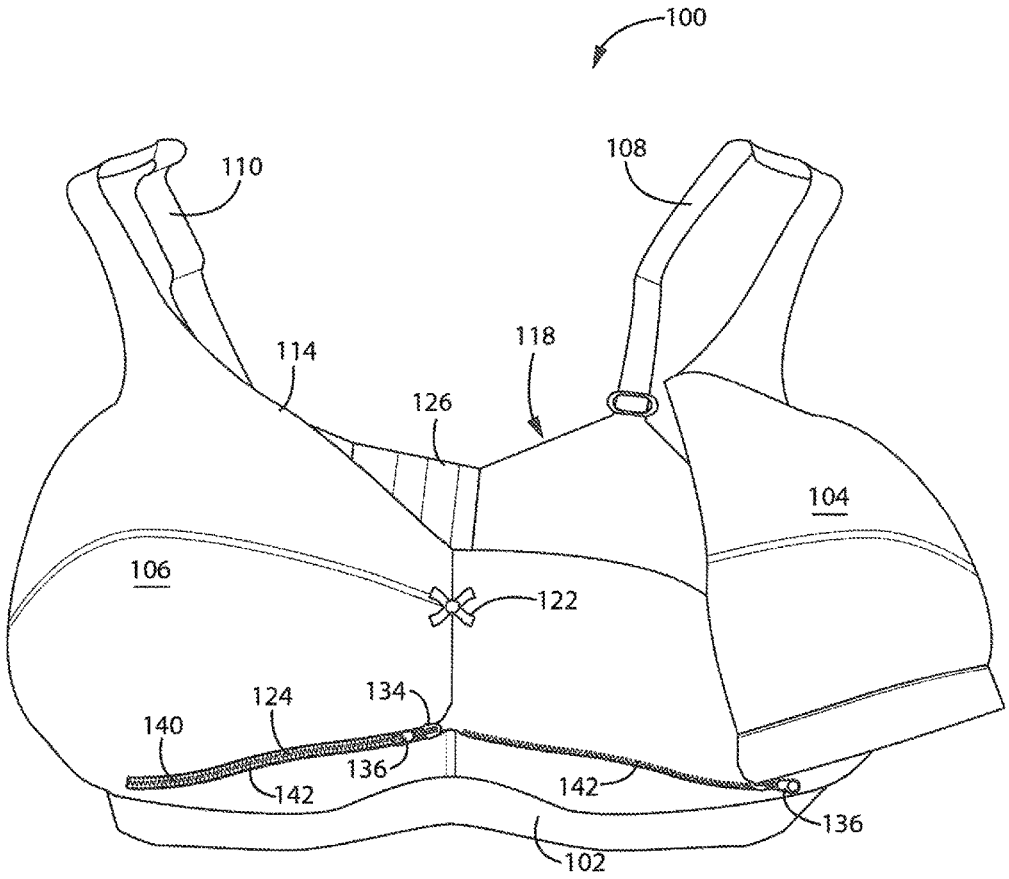
FIG. 6 is a view similar to FIG. 3 of the bra assembly shown in FIG. 4.

FIGS. 4-6 show a bra assembly 100 according to another embodiment of the invention wherein the torso band includes a selectively severable rear closure mechanism in addition to the various closure mechanisms associated with selectively exposing a single respective breast. Bra assembly 100 includes a torso band 102, a first breast cup 104, a second breast cup 106, a first shoulder strap 108, and a second shoulder strap 110. Each breast cup 104, 106 includes a lateral outward edge 112, a somewhat inboard upward directed edge 114, and a generally downward directed edge 116. Edge 116 of each breast cup 104, 106 extends generally along a respective forward facing portion of torso band 102.

Shoulder straps 108, 110 extend from an intersection associated with edges 112, 114 to a rear portion 118 of torso band 102 of bra assembly 100. It is appreciated that shoulder straps 108, 110 can be provided in an adjustable configuration wherein the length of the straps can be adjusted and/or the straps are securable to the respective breast cups and or torso band 102 at various locations to manipulate the fit associated with bra assembly 100. Bra assembly 100 includes a plurality of closure mechanisms 120 122, 124 associated with the forward facing breast cup portions 104, 106 of bra assembly 100. Bra assembly 100 also includes a selectively operable rear closure assembly or mechanism 126 associated with torso band 102 that provides a separable connection associated with rear portion 118 of torso band 102. Unlike bra assembly 20, it should be appreciated that rear closure mechanism 126 accommodates forwardly directed placement and removal of bra assembly 100 relative to the user. Closure assemblies 120, 124 are substantially similar to closure assemblies 42 and 44 described above with respect to bra assembly 20. Unlike closure assembly 44 associated with bra assembly 20, closure assembly 122 is provided in a snap and button or hook and loop configuration wherein a cleavage edge 128 associated with bra cup 104 includes one or more discrete snaps or hooks loops and a cleavage edge 130 associated with breast cup 106 includes the corresponding arrangement of buttons or loops associated with facilitating removable cooperation between cleavage edges 128, 130 associated with breast cups 104, 106 of bra assembly 100. It is appreciated that the number and orientation of the snaps, buttons, hooks, and loops associated with closure assembly 122 can be provided in a plethora of configurations.

Like bra assembly 20, each closure mechanism 120, 124 of bra assembly 100 includes a slider 134, an optional pull tab 136, and a respective pair of toothed interfaces 140, 142 associated with the respective closure mechanism 120, 124 to accommodate the selective exposure of a breast disposed behind the respective breast cup 104, 106. Referring to FIG. 5, translation of slider 134 associated with closure mechanism 120 of breast cup 104 in an outward lateral direction, indicated by arrow 148, facilitates separation between lower cup edge 116 and torso band 102 proximate the underside of the respective breast. Disengagement of the one or more snap and button or hook and loop pairs associated with closure mechanism 122 allows outward lateral displacement of breast cup 104 so as to expose a majority of the breast disposed therebehind while breast cup 106 substantially covers and supports the alternate breast.

Upon completion of a feeding activity, translation of slider 134 associated with closure mechanism 120 in an inward lateral direction, indicated by arrow 150, and reestablishing the "closed" configuration of closure mechanism 122 repositions cups 104, 106 over the respective breast. Like bra assembly 20, it should be appreciated that the outward lateral directions refer to displacing sliders 134 relative to the cleft defined by the cleavage or the medial longitudinal anatomical line of the wearer. Like bra assembly 20, closure mechanisms 120, 122, 124 are each configured to be operable by a single hand and closure mechanism 122 enhances the single-handed operability of closure mechanisms 120, 124 during the opening and closing activities.

Each of bra assemblies 20, 100 provide a bra assembly that is constructed to allow selective exposure of a single breast while maintaining coverage and support of the remaining breast and do so in a manner wherein the respective breast cup associated with the exposed breast is translatable in an outward lateral direction so as to be substantially or entirely out of the way of the feeding activity and any spillage associated therewith to maintain a dry and sanitary condition associated with the respective breast cups. Each of bra assemblies 20, 100 are further constructed to allow selective exposure of either breast and in a manner wherein operation of the multiple closure assemblies associated with the nursing activity can be manipulated between the "open" and "closed" configurations via single-handed interaction with the respective closure assembly. Such configurations allow the user to conveniently and expeditiously expose a single desired breast while maintaining coverage and support of the adjacent breast.

Figure 12:
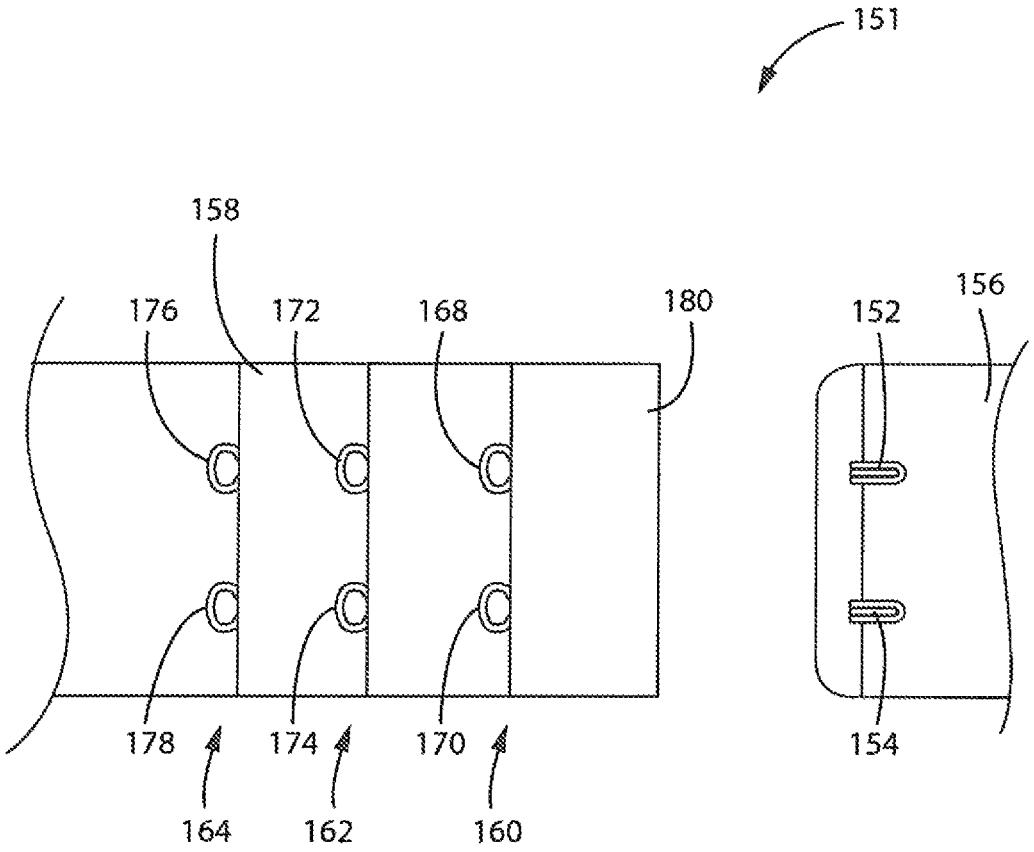
FIG. 12 is a plan view of an exemplary hook and loop closure mechanism or arrangement associated with use the closure mechanisms of the bra assemblies shown in FIGS. 1-6 or for cooperation with the bra closure assemblies shown in FIGS. 7-11.

As alluded to above, one or more of closure mechanisms 122, 126 of bra assembly 100 can be provided in a hook and loop configuration configured to allow separation of respective ends of torso band 102 and/or selective separation of the cleavage edges 128, 130 associated with breast cups 104, 106. FIG. 12 shows an exemplary hook and loop closure arrangement 151 usable as one or more of closure mechanisms 122, 126. Closure arrangement 151 includes one or more hooks 152, 154 that are secured to a respective end 156 of a torso band or cleavage edge of a breast cup. Another end 158 of the corresponding torso band and/or breast cup includes one or more rows 160, 162, 164 of a corresponding number of loop pairs 168, 170; 172, 174; 176, 178. Preferably, each row 160, 162, 164 of loop pairs includes a corresponding number of discrete loops that removably cooperate with a respective hook 152, 154. It is further appreciated that hooks 152, 154 may also be provided in a plurality of rows such that multiple rows of hook pairs cooperate with a corresponding number of respective loop pairs. It is appreciated that the plurality of hooks and loops can alternatively be provided as a plurality of snaps and buttons configured to removably cooperate with one another to accommodate the connection and separation of the respective ends of the respective portions of the underlying bra assembly.

As is commonly understood, cooperation of respective hooks 152, 154 with a respective row of loop pairs manipulates the tension and thereby the fit associated with the torso band and/or breast cups by manipulating the circumferential size as hooks 152, 154 are engaged with respective loop pairs 168-178 relative to distal end 180 associated with end 158. It is appreciated that separation of ends 156, 158 associated with the respective torso band or breast cup requires association and dissociation of the each of the respective hooks 152, 154 and the desired set of respective loops 168-178. Manipulation of ends 156, 158 relative to one another to effectuate the desired engagement and disengagement of the closure mechanism can be somewhat difficult for inexperienced users, single-handed operation, and users with infirmities such as arthritis, limited manual dexterity, and/or limited flexibility. Such difficulties can be compounded when the user is required to positionally associate a plurality of rows and/or a plurality of respective closure interfaces relative to one another but proper association of the respective closure interferences associated with the closure mechanism must be effectuated to achieve the desired fit and comfort of the bra assembly.

Figure 7:
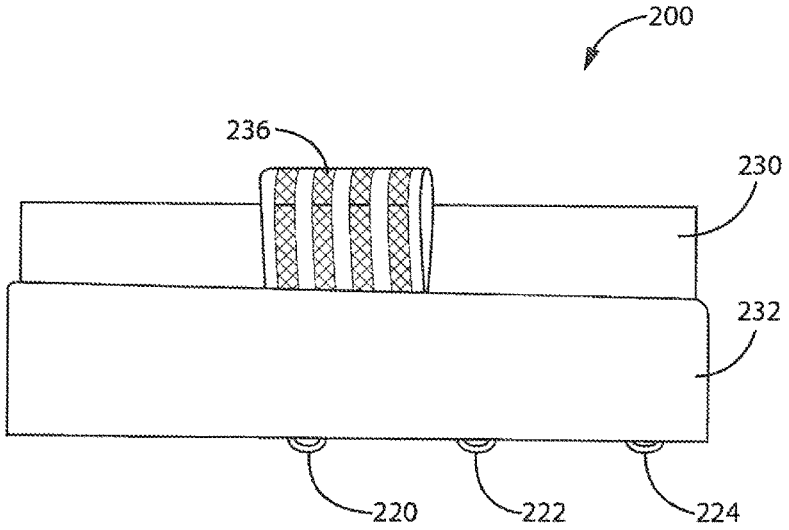
FIG. 7 is a perspective view a bra closure assembly according to another embodiment of the invention in a closed arrangement.
Figure 8:
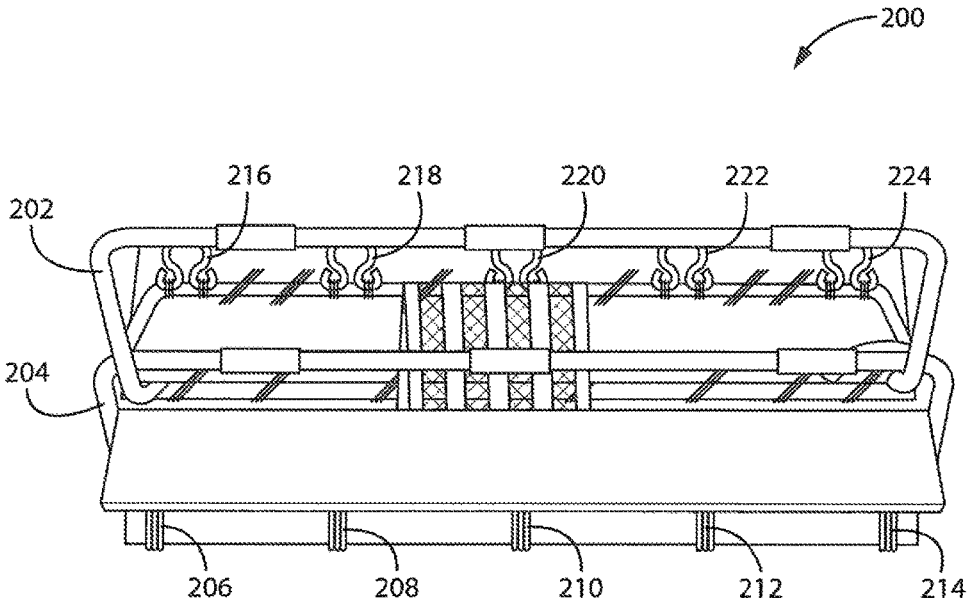
FIG. 8 is a perspective view of the bra closure assembly shown in FIG. 7 in a partially open configuration.
Figure 9:
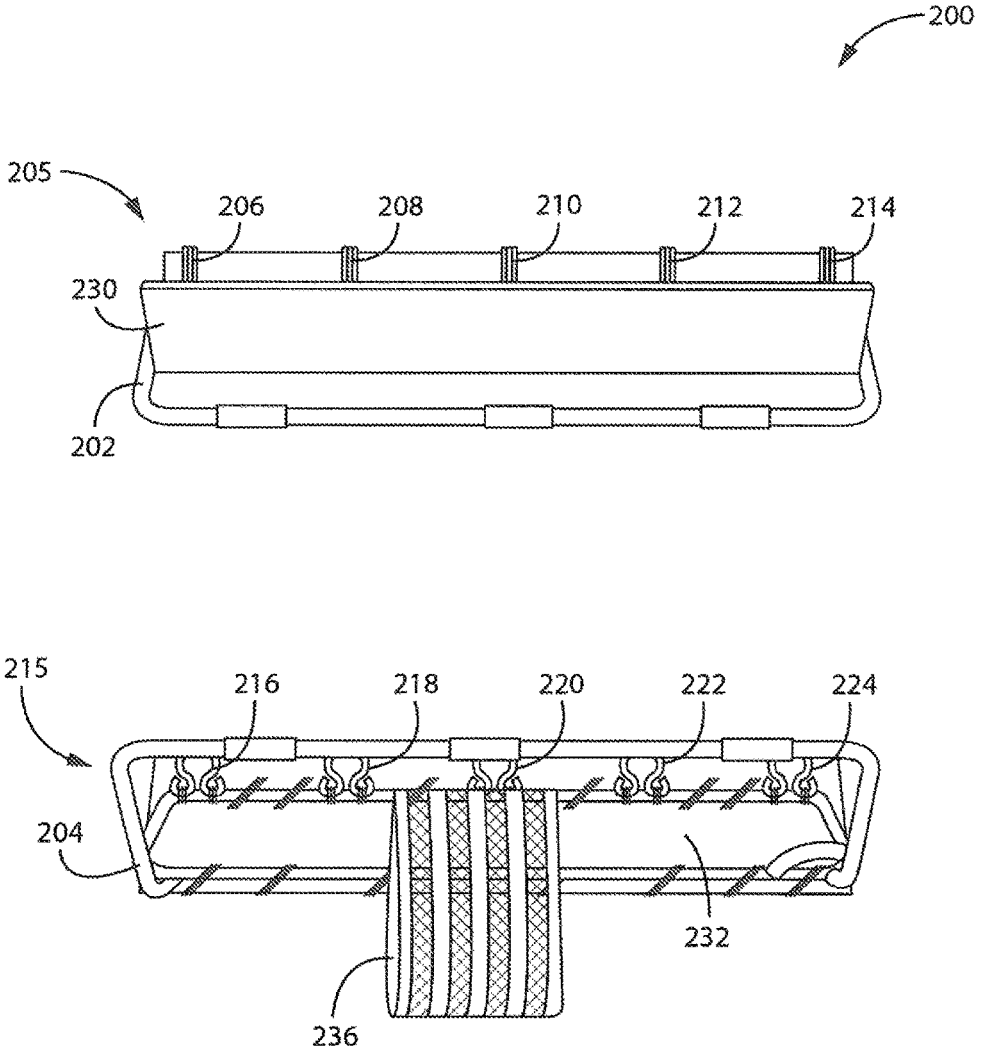
FIG. 9 is a perspective view of the bra closure assembly shown in FIG. 7 in an open configuration such that a first portion of the closure assembly and a second portion of the closure assembly disengage one another.

FIGS. 7-11 show various assemblies according to further embodiments of the invention. Referring to FIGS. 7-9, another embodiment of the present invention discloses a closure mechanism 200 that is configured to manipulate the number of discrete associations or connection interfaces that must be effectuated to achieve the desired "open," and "closed" association of respective ends associated with a separable torso band, such as torso band 102, or separable breast cups, such as that associated with closure mechanism 122, relative to one another.

Closure mechanism 200 includes a first portion or frame body 202 and a second portion or frame body 204 that removably cooperate with one another. Frame body 202 includes a plurality of connection interfaces 205 of hooks 206, 208, 210, 212, 214 that are secured to frame body 202. A plurality of connection interfaces 215 or eyelets or loops 216, 218, 220, 222, 224 are secured to frame body 204. Hooks 205 and loops 215 are oriented and positioned the removably cooperate with a respective alternate hook or loop arrangement associated with an underlying bra assembly such that respective frame bodies 202, 204 can be secured to respective alternate ends associated with a torso band closure, such as mechanism 126, or a separable breast cup closure mechanism, such as closure mechanism 122. As explained further below with respect to FIGS. 10 and 11, it is appreciated that the number and orientation of connection interfaces 205, 215 can be provided in a variety of arrangements. It is further appreciated that interfaces 205, 215 can be provided in other operational modalities, such as snaps and buttons, rather than hooks and loops as well.

Frame bodies 202, 204 removably cooperate with one another via a reduced number and preferably a single connection interface associated with providing a closed orientation of closure mechanism 200, as shown in FIG. 7, and an open or separated configuration of closure mechanism 200, as shown in FIG. 9. Each frame body 202, 204 includes an optional pad 230, 232 associated with limiting exposure of the user to frame bodies 202, 204 as well as the plurality of connection interfaces 205, 215. An optional pull tab 236 is secured to one of frame bodies 202, 204 and configured such that user interaction with pull tab 236 allows separation and cooperation of frame bodies 202, 204. Preferably, pull tab 236 cooperates with frame bodies 202, 204 in a manner that operation of pull tab 236 is intuitive with respect to the operation of the closure assembly.

Once secured to the respective ends of a torso band or cup arrangement of a bra assembly, the single or reduced number of connection interfaces associated with securing frame body 202 relative to frame body 204, in addition to the optional pull tab 236, facilitates single-handed user interaction with respect to manipulation of closure mechanism 200 between the "open" and "closed" conditions. As mentioned above, first and second frame bodies preferably cooperate with one another in a manner wherein the cooperation of the single connection interface is intuitive to the user.

Figure 10:
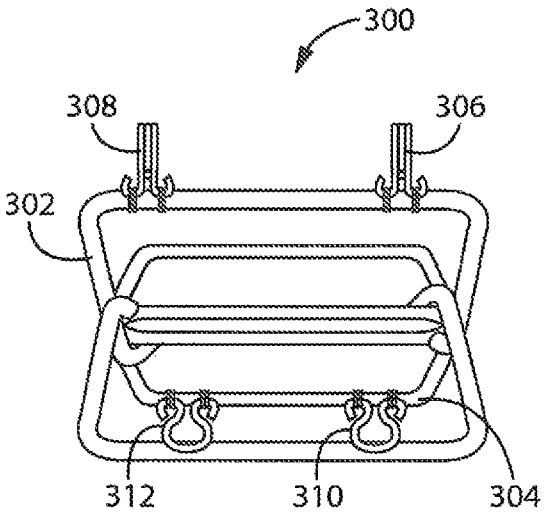
FIG. 10 is a view similar to FIG. 8 of a bra closure assembly according to another embodiment of the invention.
Figure 11:
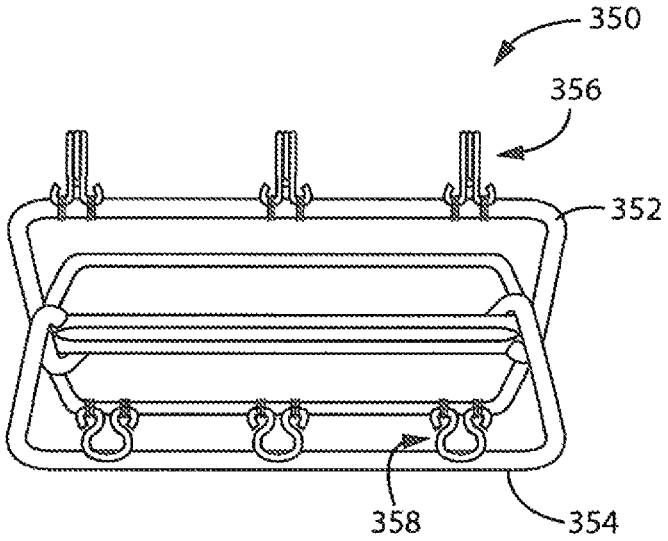
FIG. 11 is a view similar to FIG. 10 of a bra closure assembly according to another embodiment of the invention.

FIGS. 10 and 11 show additional embodiments of a connection assembly or closure mechanisms having the optional padding and pull tab removed therefrom. As shown in FIG. 10, closure mechanism 300 includes a first portion or frame body 302 that removably cooperates with a second portion or frame body 304. A plurality of connection interfaces are associated with the respective frame bodies 302, 304 such that a plurality of hooks 306, 308 are secured to first frame body 302 and a plurality of loops 310, 312 are secured to second frame body 304. Hooks 306, 308 and loops 310, 312 are constructed and oriented to cooperate with a hook and loop configuration secured to respective ends of a torso band and/or cleavage edge of a respective breast cup of an underlying bra assembly.

First frame body 302 and second frame body 304 removably cooperate with one another via a single connection interface thereby reducing the: discrete number of associations and motions that must be provided to facilitate connection and separation of the respective ends. Said another way, once the multiple connection interfaces associated with hooks 306, 308 and loops 310, 312 are established with respect to an underlying bra assembly, connection mechanism 300 allows separation and connection of the respective ends of the bra assembly, whether associated with the torso band or a front or breast cup closure mechanism, via achieving an interfering association of first frame body 302 relative to second frame body 304 via a single connection interface.

FIG. 11 shows another connection assembly 350 usable with bra assemblies such as bra assemblies 20, 100. Like closure mechanisms 200 and 300, closure mechanism 350 includes a first frame portion or frame body 352 that removably cooperates with a second frame portion or second frame body 354. A plurality of hooks 356 are secured to first frame body 352 and a plurality of loops 358 are secured to second frame body 354. Hooks 356 and loops 358 are constructed and configured to provide a connection interface wherein the hooks and loops removably cooperate with respective ends of a torso band or cleavage edge associated with breast cups of an underlying bra assembly. Connection assembly 350 also reduces the number of connection interfaces that must be associated with one another to achieve the "open" and "closed" configuration of the respective closure of the underlying bra assembly.

Comparatively, closure mechanism 200 provides 5:1 reduction, closure mechanism 300 provides a 2:1 reduction, and closure mechanism 350 provides a 3:1 reduction in the number of connection interfaces that must be established with respect to "opening" and "closing" the respective closure mechanism associated with the underlying bra assembly and are each preferably constructed to be operated in a single-handed manner. The first and second frame bodies of each of closure mechanisms 200, 300, 350 are each also preferably constructed to provide a generally flat configuration associated with cooperation of the respective frame bodies when in the "closed" position so as to mitigate discomfort to the user associated with the utilization of any of closure mechanisms 200, 300, 350. It is further appreciated that closure mechanisms 200, 300, 350 can be utilized for manipulating rear torso band closures, front torso band closures, and/or front breast cup closure mechanisms wherein the respective closure mechanisms associated with the underlying bra assemblies include multiple connection interfaces that must be associated to effectuate the desired "open" or "close" activity. It is further appreciated that the respective orientation and number of connection interfaces associated with closure assemblies 200, 300, 350 are merely exemplary and closure assemblies having other numbers and orientations of connection interfaces are envisioned and within the scope of the present application.

The various bra and bra closure assemblies disclosed herein provide apparel and apparel closure assemblies that can be conveniently configured to allow selective exposure of either breast without substantial exposure of the adjacent breast and in a manner that reduces incidence of wetting of the covering or breast cup associated with the exposed breast. The various apparel and adjustable closure arrangements are configured to accommodate single handed exposure of a single breast for feeding activities and in a manner wherein the apparel can better accommodate changes in the size and shape of a women's breasts due to lactation and/or aging, and provided easier operability than bra assembly wherein the closure mechanisms include multiple connection interfaces.

Therefore, one embodiment of the invention includes bras and methods of forming bras suitable for nursing activities. The bra assembly includes a pair of breast cups that are selectively securable to a torso band. A first closure assembly is disposed between each breast cup and the torso band and extends in a lateral direction generally below a respective breast. A second closure assembly includes first and second portions that are each secured to a respective breast cup. The first and second portions of the second closure removably cooperate with one another such that each breast can be selectively exposed by lateral outward translation of the respective breast cup.

Another embodiment of the invention that is usable or combinable with one or more of the features or embodiments disclosed above includes a bra assembly having a torso band that is configured to extend about a torso of a wearer. The assembly includes a first breast cup and a second breast cup that are each connected to the torso band and each have a generally triangular shape defined by a laterally outward edge, a cleavage edge, and an upper edge. A first shoulder strap and a second should strap each extend between a respective one of the first breast cup and the second breast cup and a back portion of the torso band. A first closure assembly and a second closure assembly are disposed between a respective breast cup and the torso band. Each of the first and second closure assemblies are operable to selectively secure a longitudinal lower edge of the respective first and second breast cup to the torso band. A third closure assembly is isolated from the torso band and includes a first portion that is secured to the cleavage edge of the first breast cup and a second portion that removably cooperates with the first portion and is secured to the cleavage edge of the second breast cup such that the first breast cup and the second breast cup can each be selectively swung in a respective outward lateral direction to expose a breast disposed therebehind without affecting a position of the other breast cup.

Another embodiment of the invention that is usable or combinable with one or more of the above embodiments includes a method of forming a nursing bra. The method includes connecting, a right breast cup to a left breast cup with a torso band that is connected to respective lateral outward edges of the respective right and left breast cups. A bottom edge of each of the right and left breast cups is connected to the torso band with a respective variable length closure that includes a first portion that is secured to a respective one of the right and left breast cups and a second portion that is secured to the torso band. A cleavage edge of each of the right breast cup and the left breast cup is connected to each other with a selectively operable closure that assists operation of the variable length closure during opening and closing operation of each of the right and left breast cups.

Another embodiment of the invention that is useable with one more of the above features, aspects, or embodiments includes a bra closure assembly having a first frame body and a second frame body that removably cooperate with each other and removably cooperate with respective portions of a bra closure or clasp assembly. The first frame body includes at least two eyelets that are attached thereto. Each of the at least two eyelets are oriented to removably cooperate with a hook of a bra closure. The second frame body includes at least two hooks that are attached thereto and oriented to cooperate with a respective eyelet of the bra closure. The assembly includes a first clasp portion that is defined by the first frame body and a second clasp portion that is defined by the second frame body. The first clasp portion and the second clasp portion removably cooperate with one another to open and close the bra closure with fewer interfaces than associated with cooperation of the hooks and eyelets of the bra closure.

It is appreciated that the various bra and bra closure assemblies disclosed herein include various additions, modifications, and rearrangements that are within capabilities of those skilled in the art from the disclosure of the present application. It is intended that the appended claims cover all such additions, modifications, and rearrangements. Expedient embodiments of the present invention are differentiated by the appended claims which also form part of the specification.

What is claimed is:

1. A bra assembly comprising:

a torso band being an elongate structure configured to extend about a torso of a wearer;

a first breast cup and a second breast cup connected to the torso band, each breast cup defined by a laterally outward edge, a cleavage edge, an upper edge, and a longitudinal lower edge, wherein each laterally outward edge is inseparably connected to the torso band;

a first shoulder strap and a second should strap that each respectively extend between a respective one of the first breast cup and the second breast cup and a back portion of the torso band;

a first breast cup closure assembly disposed between the first breast cup and the torso band;

a second breast cup closure assembly disposed between the second breast cup and the torso band, each of the first and second breast cup closure assemblies being operable to selectively secure the longitudinal lower edge of the respective first and second breast cup to the torso band;

a cleavage edge closure assembly between the first breast cup and the second breast cup and includes a first portion secured to the cleavage edge of the first breast cup and a second portion that removably cooperates with the first portion and is secured to the cleavage edge of the second breast cup such that the first breast cup and the second breast cup can each be selectively swung in a respective outward lateral direction to expose a breast disposed therebehind without affecting a position of the other breast cup;

wherein the first and second breast cup closure assemblies are disposed between the cleavage edge closure assembly and the torso band, and wherein the torso band is inseparable at a location below and between the first and second breast cups.

2. The bra assembly of claim 1 wherein the first breast cup and second breast cup closure assemblies are each further defined as one of a zipper and a hook and loop closure assembly.

3. The bra assembly of claim 1 wherein the cleavage edge closure assembly is further defined as an elongated clip wherein the first and second portions cooperate with one another to accommodate engagement and disengagement between the first and second portions.

4. The bra assembly of claim 1 wherein the torso band and the first and second shoulder straps are continuous and inseparable.

5. The bra assembly of claim 1 further comprising a back closure that includes a first portion that is attached to a first end of the torso band and a second portion that is attached to a second end of the torso band, the first and second portions of the back closure selectively cooperating with one another to secure the first and second ends of the torso band to one another.

6. The bra assembly of claim 5 wherein the back closure further comprises a closure assembly configured to removably cooperate with the first portion and the second portion of the back closure.

7. The bra assembly of claim 6 wherein the closure assembly of the back closure includes a first part that removably cooperates with the first portion of the back closure and a second part that removably cooperates with the second portion of the back closure and the first part of the closure assembly.

8. The bra assembly of claim 1 further comprising a selectively operable rear closure having a first portion associated with a first end of the torso band and a second portion that removably cooperates with the first portion and is associated with a second end of the torso band.

9. A method of forming a nursing bra, the method comprising:

connecting a right breast cup and a left breast cup to a torso band, the torso band being an elongate structure configured to extend about a torso of a wearer, the torso band being inseparably connected to respective lateral outward edges of the right and left breast cups;

connecting a bottom edge of each of the right and left breast cups to the torso band with a variable length closure having a first portion secured to a respective one of the right and left breast cups and a second portion secured to the torso band;

connecting a cleavage edge of each of the right breast cup and the left breast cup directly to each other with a selectively operable closure configured to assist operation of the variable length closure during opening and closing operation of each of the right and left breast cups; and wherein the variable length closures connected to the bottom edges of the right and left breast cups are disposed between the selectively operable closure and the torso band.

10. The method of claim 9 further comprising forming the variable length closure as one of a zipper closure mechanism, a snap and button closure mechanism, and a hook and loop closure mechanism.

11. The method of claim 9 further comprising extending a shoulder strap from an upper edge or each of the right and left breast cups to a rear portion of the torso band.

12. The method of claim 9 further comprising providing a selectively operable rear closure having a first portion associated with a first end of the torso band and a second portion that removably cooperates with the first portion and is associated with a second end of the torso band.

13. The method of claim 12 further comprising providing a closure assembly configured to be disposed between the first portion and the second portion of the selectively operable rear closure and provide fewer interfaces that must be associated to effectuate opening and closing the closure assembly than must be associated to effectuate opening and closing of the selectively operable rear closure.

14. The method of claim 9 further comprising forming the torso band as a continuous loop.

* * * * *